US011830389B2

(12) United States Patent
Karl et al.

(10) Patent No.: US 11,830,389 B2
(45) Date of Patent: Nov. 28, 2023

(54) IDENTIFICATION TAG FOR LUGGAGE ARTICLE

(71) Applicant: Samsonite IP Holdings S.a r.l., Luxembourg (LU)

(72) Inventors: Philip Justin Karl, Rehoboth, MA (US); Ulliyada Bopanna, Milton, MA (US)

(73) Assignee: Samsonite IP Holdings S.a r.l., Luxembourg (LU)

( * ) Notice: Subject to any disclaimer, the term of this patent is extended or adjusted under 35 U.S.C. 154(b) by 0 days.

(21) Appl. No.: 17/696,432

(22) Filed: Mar. 16, 2022

(65) Prior Publication Data

US 2023/0126818 A1 Apr. 27, 2023

Related U.S. Application Data

(60) Provisional application No. 63/271,006, filed on Oct. 22, 2021.

(51) Int. Cl.
*G09F 3/14* (2006.01)
*G09F 3/20* (2006.01)
(Continued)

(52) U.S. Cl.
CPC ..... *G09F 3/14* (2013.01); *G09F 3/201* (2013.01); *G09F 7/04* (2013.01); *G09F 2003/0254* (2013.01)

(58) Field of Classification Search
CPC ... G09F 3/14; G09F 3/201; G09F 7/04; G09F 2003/0254; A45C 15/00; A45C 2005/037
See application file for complete search history.

(56) References Cited

U.S. PATENT DOCUMENTS 10,827,812 B2 11/2020 Reh et al.
2006/0027645 A1* 2/2006 Granick ..... G09F 3/20 235/380
(Continued)

FOREIGN PATENT DOCUMENTS

CA 2688357 C 11/2017
DE 202017003700 U1 9/2017
(Continued)

OTHER PUBLICATIONS

Extended European Search Report for European Patent Application No. 22203080.1 dated Feb. 21, 2023, 13 pages.

*Primary Examiner* — Gary C Hoge
(74) *Attorney, Agent, or Firm* — Dorsey & Whitney LLP

(57) ABSTRACT

In one embodiment, a luggage article (100) is disclosed. The luggage article (100) includes a shell (102) with forming an internal storage volume (166). A recess (140) is formed in the shell (102) and includes a base wall (152) that defines a substantially planar surface (142), and a first peripheral wall (144) that at least partially surrounds the base wall (152) and forms a peripheral shape (146) in the shell (102). The luggage article (100) includes an identification tag assembly (112) including: a display body (122) defining a second peripheral shape (150) and configured to receive an information element (128) configured to display information (164), and a first attachment element (130); a second attachment element (132) coupled to the shell (102) proximate to the recess (140). The first attachment element (130) and the second attachment element (132) together releasably secure the display body (122) to the shell (102) in the recess (140).

19 Claims, 9 Drawing Sheets

(51) Int. Cl.

| | |
|---|---|
| ***G09F 7/04*** | (2006.01) |
| *G09F 3/02* | (2006.01) |

(56) References Cited

U.S. PATENT DOCUMENTS

| | | | | |
|---|---|---|---|---|
| 2014/0291405 | A1* | 10/2014 | Harkes | G06K 19/07749 235/492 |
| 2017/0103292 | A1* | 4/2017 | Reh | G07B 15/02 |
| 2020/0214407 | A1* | 7/2020 | Nichols | A45F 4/02 |
| 2020/0229568 | A1* | 7/2020 | Nichols | A45C 13/1084 |
| 2021/0196019 | A1* | 7/2021 | Charles | G01G 19/52 |
| 2021/0321736 | A1* | 10/2021 | Tonelli | A45C 5/03 |
| 2022/0094204 | A1* | 3/2022 | Cloyd | A45C 15/00 |
| 2022/0248820 | A1* | 8/2022 | Dauchin | A45C 5/14 |

FOREIGN PATENT DOCUMENTS

| | | | |
|---|---|---|---|
| DE | 202019104125 | U1 | 10/2019 |
| EP | 1800560 | B1 | 8/2008 |
| EP | 2091036 | B1 | 11/2016 |
| EP | 3590382 | A1 | 1/2020 |
| WO | 2021018736 | A1 | 2/2021 |

* cited by examiner

IDENTIFICATION TAG FOR LUGGAGE ARTICLE

CROSS-REFERENCE TO RELATED APPLICATIONS

This application claims the benefit of priority pursuant to 35 U.S.C. § 119(e) of U.S. provisional patent application No. 63/271,006, filed 22 Oct. 2021, entitled "IDENTIFICATION TAG FOR LUGGAGE ARTICLE," which is hereby incorporated by reference herein in its entirety.

BACKGROUND

Travelers frequently travel with many pieces of luggage. Luggage is frequently delayed or lost. Many travelers may have similar luggage articles that can be easily confused with one another. To address these issues, luggage articles have employed identification ("ID") tags that can be used to identify a luggage article and route it to its owner or to distinguish similar-looking luggage articles. Such ID tags are traditionally tied to a handle or other part of the luggage article. Traditional ID tags hang off the case with a dedicated anchor or have been looped onto a carry handle. These approaches have a number of disadvantages. For example, a freely hanging ID tag can create a pendulum effect as a traveler walks with the luggage. This pendulum effect allows the ID tag to swing back and forth and get caught on obstacles as the traveler moves, subjecting the tag to damage or loss. Additionally, a strap that secures the ID tag may come undone, be worked loose by the pendulum motion, or become snagged on an object and be broken or damaged. Traditional approaches also create an untidy or unsightly appearance on the luggage and a lack of an integrated case design aesthetic. A freely hanging ID tag may also contribute to security issues as the user's contact information may be visible to any passerby. Features to enable the secure attachment of ID tags to luggage articles to reduce or prevent damage, increase security, and to enable an ID tag that enhances the aesthetic appearance of a luggage article are desired.

BRIEF SUMMARY

In one embodiment, a luggage article is disclosed. The luggage article includes a shell forming an internal storage volume. A recess is formed in the shell and includes: a base wall that defines a substantially planar surface, and a first peripheral wall that at least partially surrounds the base wall and forms a peripheral shape of the recess. The luggage article includes an identification tag assembly including: a substantially planar display body defining a second peripheral shape, and configured to receive an information element, and a first attachment element; a second attachment element coupled to the shell proximate to the recess. The second peripheral shape of the display body compliments the peripheral shape of the recess such that the display body is receivable in the recess, and the first attachment element and the second attachment element together releasably secure the display body to the shell in the recess.

Optionally in some embodiments, the recess includes a second base wall that defines a second substantially planar surface, and a second peripheral wall that at least partially surrounds the second base wall. The first peripheral wall and the second peripheral wall may together form the first peripheral shape of the recess in the shell.

Optionally in some embodiments, the luggage article includes a channel defined in the shell and in communication with the recess; and a third attachment element coupled to the display body and further defining a portion of the second peripheral shape. The third attachment element may have a flexible property or a rigid property and is receivable in the channel.

Optionally in some embodiments, the second base wall is in communication with the first base wall and defines a portion of the recess. The identification tag assembly may further includes a flexible element coupled to the display body and further defining a portion of the second peripheral shape, and an anchor coupled to the shell and the flexible element an configured to flexibly secure the display body to the shell.

Optionally in some embodiments, the first attachment element and the second attachment element include respective first and second magnetic elements that generate an attractive magnetic force therebetween.

Optionally in some embodiments, one of the first magnetic element or the second magnetic element comprises a permanent magnet.

Optionally in some embodiments, permanent magnet comprises at least one of iron, cobalt, nickel, aluminum, samarium, neodymium, or combinations thereof.

Optionally in some embodiments, the shell includes a first surface pattern and the display body includes a second surface pattern.

Optionally in some embodiments, the first surface pattern and the second surface pattern are different than one another.

Optionally in some embodiments, the first surface pattern and the second surface pattern correspond.

Optionally in some embodiments, the first attachment element and the second attachment element comprise respective first and second releasable mechanical fasteners.

Optionally in some embodiments, the luggage article includes a fourth attachment element coupled to the shell and the third attachment element and configured to flexibly secure the display body to the shell.

Optionally in some embodiments, the peripheral shape and the second peripheral shape are such that the display body and the third attachment element are both receivable in the recess.

Optionally in some embodiments, the identification tag assembly includes an opaque side and a transparent side, wherein the information element is selectively receivable between the opaque side and the transparent side and is visible through the transparent side.

Optionally in some embodiments, the transparent element includes a receptacle formed therein, the transparent element forming a pocket with the display body adapted to receive the information element.

Optionally in some embodiments, the shell includes a lid and a base, wherein the lid and the base are hingedly coupled to one another and selectively closable by a closure mechanism.

In one embodiment, an identification tag assembly for a luggage article is disclosed. The luggage article includes a recess formed in a shell of the luggage article. The recess includes a base wall that defines a substantially planar surface, and a first peripheral wall that at least partially surrounds the base wall and forms a peripheral shape of the recess. The luggage article includes a display body defining a second peripheral shape and configured to receive an information element configured to display information; a first magnetic element; and a second magnetic element coupled to a surface of the luggage article proximate to the recess. The peripheral shape and the second peripheral shape are such that the display body is receivable in the recess, and the first magnetic element and the second magnetic element together releasably retain the display body within in the recess.

Optionally in some embodiments, a flexible attachment element coupled to the display body and further defining a portion of the second peripheral shape, and a fixed attachment element coupled to the shell and the flexible attachment element and configured to flexibly secure the display body to the shell. The channel is defined in the shell and in communication with the recess, and the flexible attachment element is receivable in the channel.

In one embodiment, a method of releasably securing an identification tag assembly to a luggage article is disclosed. The method includes providing a shell of the luggage article forming an internal storage volume. A recess is formed in the shell and includes: a base wall that defines a substantially planar surface, and a first peripheral wall that at least partially surrounds the base wall and forms a peripheral shape in the shell; providing the identification tag assembly including: a display body defining a second peripheral shape and configured to receive an information element configured to display information, and a first attachment element. The method includes providing a second attachment element coupled to the shell proximate to the recess. The peripheral shape and the second peripheral shape are such that the display body is receivable in the recess, and the first attachment element and the second attachment element together releasably secure the display body to the shell in the recess.

DETAILED DESCRIPTION

Figure 1:
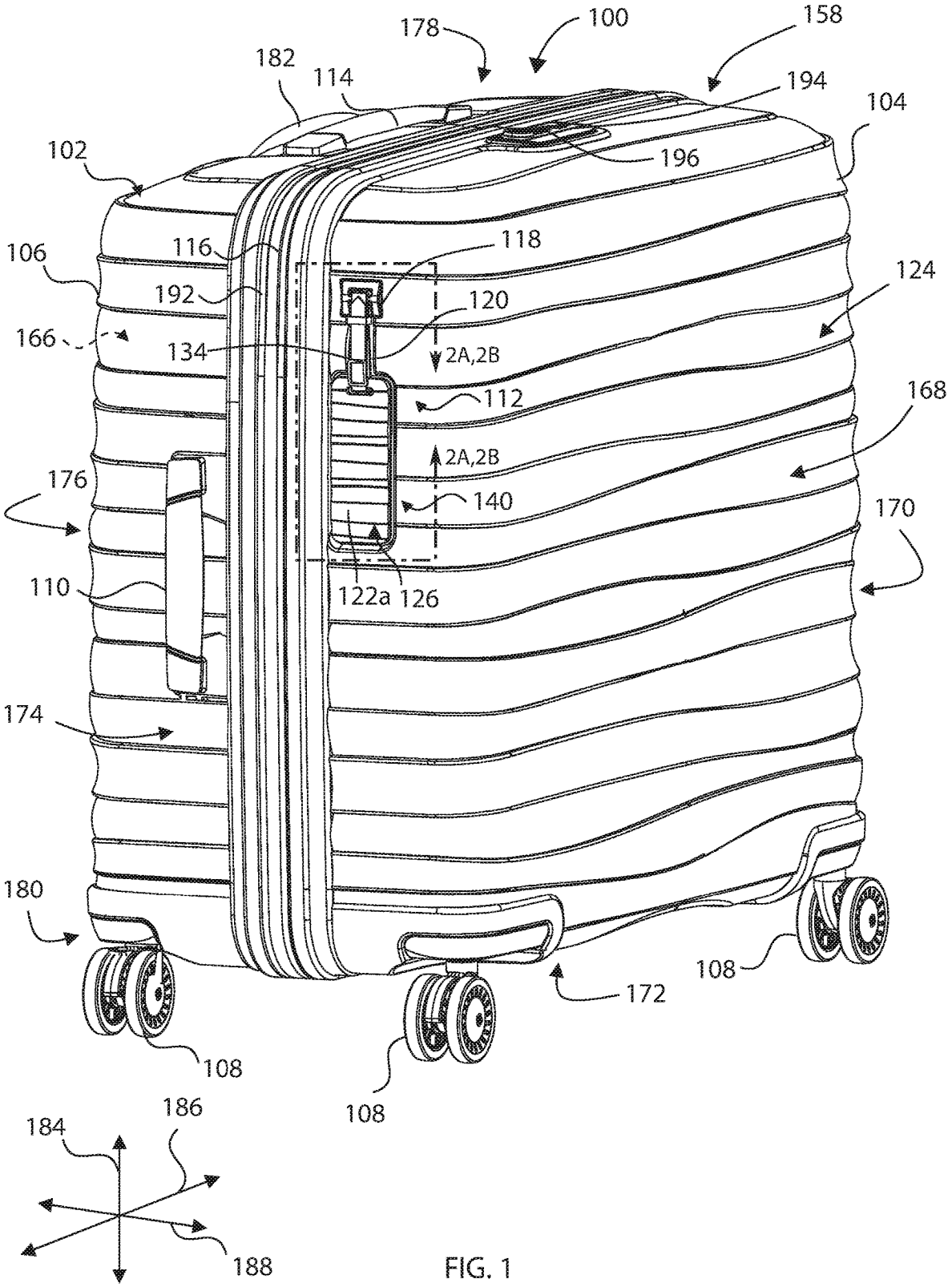
FIG. 1 is a perspective view of a luggage article with an identification tag in accordance with an embodiment.

Referring to FIG. 1-FIG. 8 an identification tag assembly 112 for a luggage article 100 according to an embodiment is disclosed. In some examples, the identification tag assembly 112 may include a display body 122 with a first attachment element 130 affixed to the display body 122. In many embodiments, the display body is substantially planar, and may be a thin body suitable to be received in a recess 140 formed in a shell 102 of the luggage article 100. In many embodiments, the first attachment element 130 has a magnetic property. In many embodiments, the identification tag assembly 112 may form a layered structure including the display body 122, the first attachment element 130, and a transparent element 190. An information element 128 may be receivable in a receptacle 198 formed in the transparent element 190, where the information element 128 is visible through and protected by the transparent element. In some embodiments, the information element 128 may be a card, placard, sign, or the like that displays the identification or other information related to the luggage article 100, the luggage article's owner, or the like. In one example, the information element may be a business card. In addition to identification information, the information element 128 may be configured to display other types of information, such as a flight number, luggage model number, luggage contents, or other information. The transparent element 190 forms a pocket with the display body adapted to receive the information element 128. In some embodiments, the identification tag assembly 112 may include additional attachment elements 118 and/or 120 suitable to movably secure the display body 122 to the shell 102.

For example, the attachment element 120 may be a strap or tether 121 and the attachment element 118 may be an anchor, where the strap 121 is coupled to both the display body 122 and the anchor 118. In this example, the strap 121 may be made of a flexible material, such as rubber, plastic, leather, or man-made or natural woven or unwoven materials, to flexibly secure the display body 122 to the shell 102. The display body 122 may have an aperture 138 formed therein and adapted to receive or otherwise engage attachment element 120.

In another example, the attachment element 120 may be a rigid element 123 attached between the attachment element 118 (e.g. an anchor) and the display body 122. The rigid element 123 may be a single link pivotally attached at one end to the attachment element 118 and pivotally attached at the other end to the display body 122. In this example, the link 123 may be made of a rigid material, such as metal, inflexible plastic, or other stiff materials. The pivot connections at either end of the link 123 movably secures the display body 122 to the shell 102. The link 123 may be more than one rigid bodies pivotally attached together.

A shell 102 of the luggage article 100 may have affixed thereto, or formed therewith, an anchor 118 including an anchor aperture 136 adapted to receive the attachment element 120. The attachment element 120 may be secured to both the display body 122 and the shell 102 via the aperture 138 and the anchor aperture 136 to flexible secure the identification tag assembly 112 to the luggage article 100. The shell 102 may define a recess 140 adapted to receive all or a part of the identification tag assembly 112 such that the identification tag assembly 112 sits substantially flush with, above, or recessed within the shell 102. The shell may include, or have affixed thereto proximate to the recess 140, a second attachment element 132 couplable to the first attachment element 130 so as to releasably secure the display body 122 to the shell 102 of the luggage article 100. In many embodiments, the second attachment element 132 has a magnetic property, such that the first attachment element 130 and the second attachment element 132 have a magnetically attractive force therebetween to releasable secure the identification tag assembly 112 within the recess 140. The display body 112 may be magnetically couplable to the luggage article 100. The identification tag assembly 112 may additionally be mechanically couplable to the luggage article 100 such as with an attachment element 120.

FIG. 1 is a perspective view of a luggage article 100 in a closed configuration, which in some examples may be a luggage case. The luggage article 100 illustrated in FIG. 1 is a hard side case. The luggage article 100 has a shell 102 comprising a plurality of panels defining an internal storage volume 166 to carry a user's belongings. The luggage article 100 and shell 102 includes a front panel 168 and an opposing rear panel 176, top panel 178 and bottom panel 172, and opposing left panel 174 and right panel 170. Corner regions 180 may be defined by the intersection of any two or three adjacent panels. Throughout this disclosure, reference may be made to a width or transverse direction 186, a length or vertical direction 184, and/or a depth direction 188. The width or transverse direction 186 is generally a direction between the left panel 174 and the right panel 170. The length or vertical direction 184 is generally a direction between the top panel 178 and the bottom panel 172. The depth direction 188 is generally a direction between the front panel 168 and rear panel 176. The transverse direction 186, length/depth direction 188, and vertical direction 184 may be mutually orthogonal in some examples. These directions are meant to be illustrative only and are in no way limiting.

The luggage article 100 can be moved between a closed configuration in which a lid 104 and a base 106 of the shell 102 are positioned adjacent one another to selectively open or close to provide access to the internal storage volume 166. The luggage article 100 can be configured in an open position with the lid 104 and the base 106 positioned apart from one another. The lid 104 and the base 106 may be pivotably attached together such as by a hinge 158 or similar mechanism, and may be releasably attached together by a closure mechanism 116 to releasably secure the lid 104 and the base 106 together in the closed configuration. In some examples, the closure mechanism 116 is a zipper 192. The closure mechanism 116 may extend entirely or partially along edges of the lid 104 and the base 106. The closure mechanism 116 may include complementary portions on each of the lid 104 and the base 106, where the complementary portions are selectively couplable or decouplable relative to one another. In some embodiments, the closure mechanism 116 may be a buckle, latch, over-center mechanism, clasp, or other device suitable to releasably secure the lid 104 and the base 106 to one another.

In some examples, the luggage article 100 may include one or more carry handles 110 and handle 114 and/or a retractable tow handle 182 extendable from a rear panel 176 of the luggage article 100. The luggage article 100 may include one or more foot elements 108 such as wheels, casters, spinner assemblies, posts, or the like to support or enable the movement of the luggage article 100 on a support surface such as a floor, street, sidewalk, or the ground. The luggage article 100 may be many types of luggage, including a hybrid spinner case, a container, or the like.

The shell 102 of the luggage case luggage article 100 may include one or more layers of material used in the manufacture of hard sided luggage cases. Reference herein to attaching or coupling to the interior or exterior surfaces of the lid 104 and/or base 106 includes attaching or coupling to the any one, or more than one, of the one or more layers of hard sided material forming the shell 102.

A locking mechanism 194 may be operable to thwart, prevent, or discourage the unauthorized opening of the luggage article 100. For example, the locking mechanism 194 may be a zipper lock operative to receive and secure pull tab actuators of the zipper 192 example of a closure mechanism 116 to prevent the actuators from moving. The locking mechanism 194 may alternately include a key or combination lock 196.

With reference to FIGS. 2A, 2B, 3, and 5, the luggage article 100 has a recess 140 formed in the shell 102. In the example shown, the recess 140 is formed in the lid 104, and more specifically in an upper side part of the lid 104. In other embodiments, the recess 140 may be formed in other parts of the shell 102, including another portion of the lid 104 or a portion of the base 106 or the top panel 178, bottom panel 172, left panel 174, right panel 170, front panel 168, or rear panel 176. The recess 140 is formed by a depression of the shell 102 into the luggage article 100. The recess 140 has a depth, length, and a width suitable to receive at least a portion of the identification tag assembly 112. For example, the recess 140 may be about 20 to 80 cm wide (e.g., in the depth direction 188 of the luggage article 100), 60 to 160 cm long (e.g., in the vertical direction 184), and 5 to 30 mm deep (e.g., in the transverse direction of the luggage article 100). The display body 122 may be suitable sized to be received within the recess 140. For example the dimensions (e.g., length, width, height) of the display body 122 may be slightly smaller than corresponding dimensions (e.g., length, width, height) of the recess 140 such that the display body 122 may be received in the recess 140.

Figure 5:
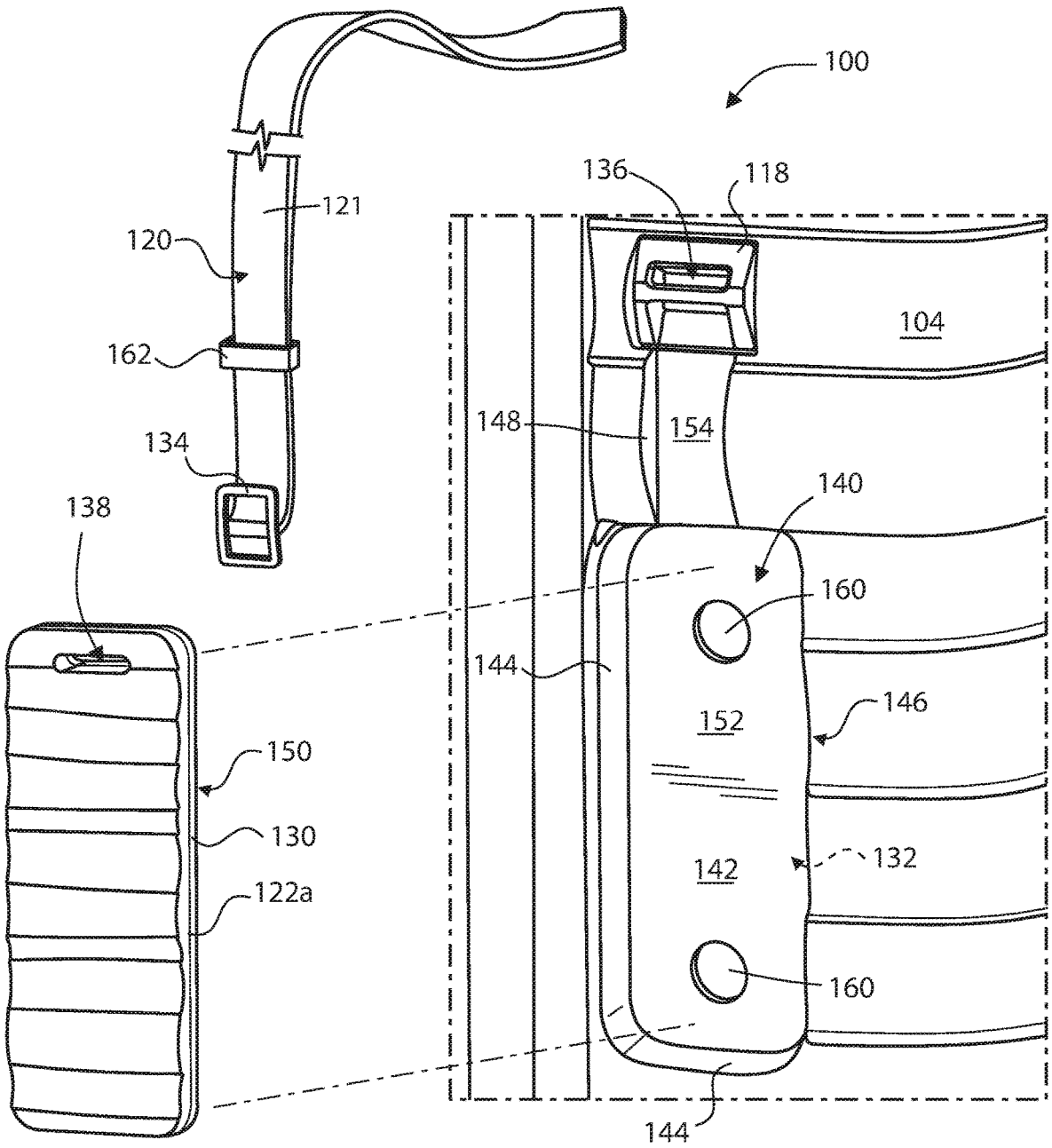
FIG. 5 is a partial exploded view of the identification tag and luggage article of FIG. 1.

With specific reference to FIG. 5, the recess 140 may include a first base wall 152 that defines a surface 142. The first base wall 152 may be recessed below the outer surface of the shell 102. In many embodiments, the first base wall 152 is substantially parallel to the outer surface of the shell 102, such as substantially parallel to one or more of the top panel 178, bottom panel 172, left panel 174, right panel 170, front panel 168, or rear panel 176. In many embodiments, the surface 142 is substantially planar. A substantially planar surface 142 may have certain advantages over a textured surface 142 or a surface 142 with three dimensional relief surfaces. For example, a substantially planar surface 142 may help reduce the depth of the recess 140 needed to receive the display body 122. In another example, a substantially planar surface 142 may enable the identification tag assembly 112 to be easily received and seated in the recess 140 and easily removed from the recess by a user. The recess 140 may include a first peripheral wall 144 that defines at least a portion of the recess 140. In some embodiments, the first peripheral wall 144 may be substantially perpendicular to the first base wall 152. In some embodiments, the first peripheral wall 144 may be slanted at an angle relative to the first base wall 152. The first peripheral wall 144 may surround all or a portion of the first base wall 152. The first peripheral wall 144 may define a first peripheral shape 146 in the shell 102. In some embodiments the first peripheral shape 146 may be a rectangle, square, circle, other polygon, rounded versions of the same or an irregular shape.

The recess 140 may optionally include a second base wall 154 that may be in communication with the first base wall 152. The second base wall 154 may be recessed into the shell 102. In some embodiments, the second base wall 154 may be separate from the first base wall 152 so as to form a second recess 140. The first base wall 152 may form a first region of the recess 140 and the second base wall 154 may form a second region of the recess 140. The second base wall 154 may be coplanar with the first base wall 152. The second base wall 154 may be offset from the first base wall 152 (e.g., higher or lower in the shell 102 in one of the vertical direction 184, transverse direction 186, or depth direction 188). The second base wall 154 may be parallel to the first base wall 152. In some embodiments, the second peripheral wall 148 may be substantially perpendicular to the second base wall 154. In some embodiments, the second base wall 154 may be slanted at an angle relative to the second peripheral wall 148. The second base wall 154 may be skewed at an angle relative to the first base wall 152. A second peripheral wall 148 may surround all or a portion of the second base wall 154. The first peripheral wall 144 and the second peripheral wall 148 may together define the first peripheral shape 146. For example the first peripheral wall 144 and the second peripheral wall 148 may define a shape of two joined rounded rectangles.

The second peripheral wall 148 and the second base wall 154 may form a channel 155 adapted to receive the attachment element 120. The channel 155 may be in communication with the recess 140 and may form a part of the recess 140. The channel 155 may be adapted to receive the attachment element 120, such as when the display body 122 is received in the recess 140. Thus, the attachment element 120, the display body 122, and/or the anchor 118 may sit slightly above, flush with, or below the outer surface of the shell 102. See, e.g., FIG. 1, FIG. 2A, FIG. 2B, and FIG. 4. The display body 122 may be less susceptible to damage than a traditional ID tag when received in the recess 140. Furthermore, by receiving the display element bodies 122 into the recess 140, the identification tag assembly 112 may not increase the overall dimensions of the luggage article 100 such as to conform to airline regulations.

Figure 2A:
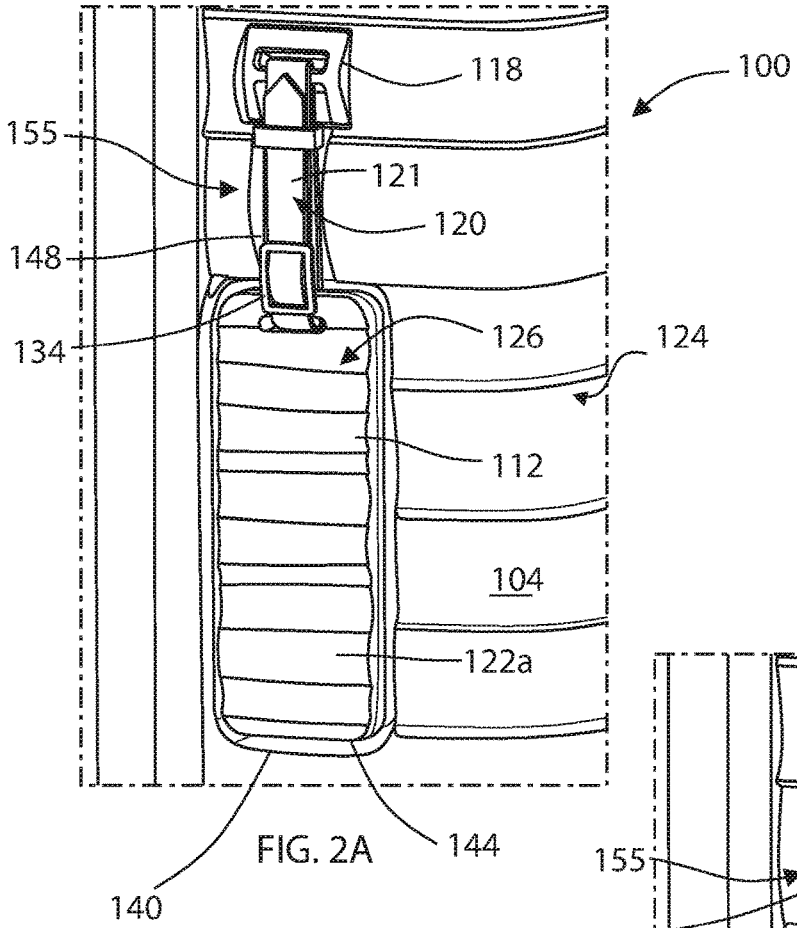
FIG. 2A is a more detailed partial perspective view of the identification tag with a surface pattern that contrasts with a surface pattern of the luggage article of FIG. 1, and the luggage article of FIG. 1.
Figure 2B:
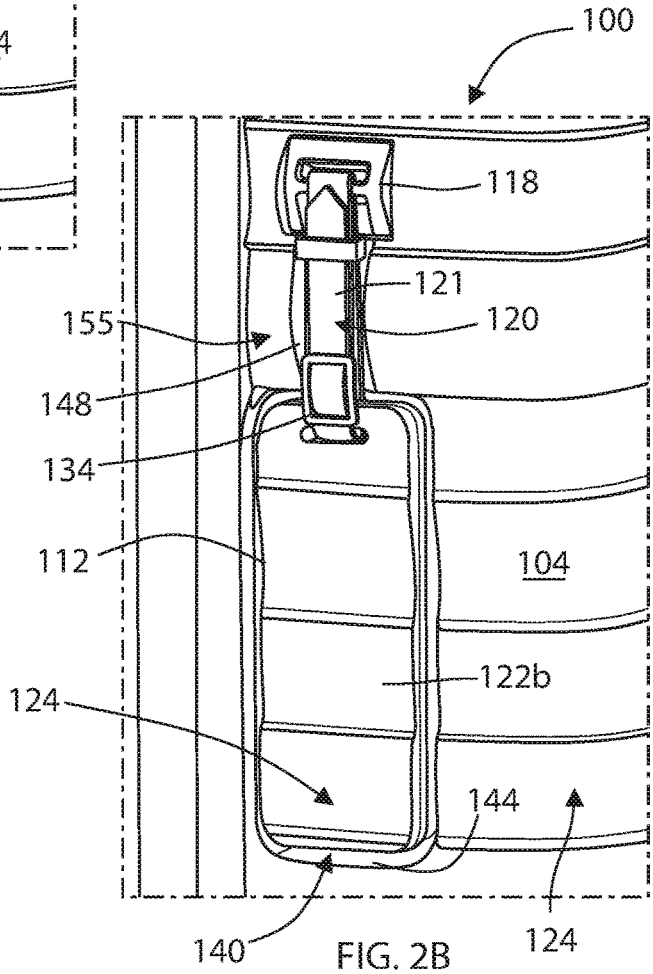
FIG. 2B is a detailed partial perspective view of an embodiment of the identification tag with a surface pattern that matches a surface pattern of the luggage article of FIG. 1, and the luggage article of FIG. 1.
Figure 3:
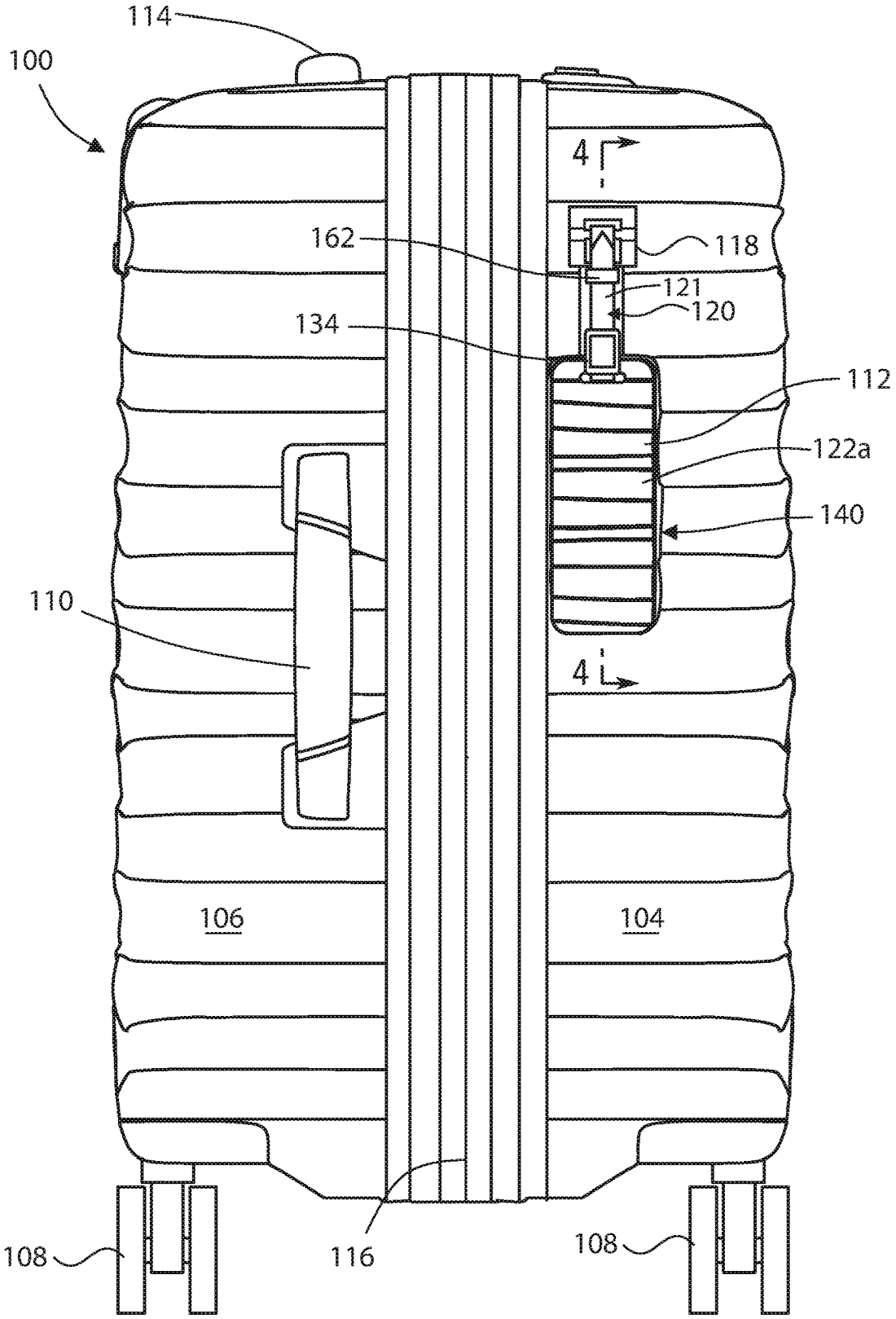
FIG. 3 is a side elevation view of the luggage article of FIG. 1.

The identification tag assembly 112 includes a display body 122, for example, a display body 122*a* shown for example in FIG. 2A with a surface pattern that contrasts with a surface pattern of the shell 102, or a display body 122*b* shown for example in FIG. 2B with a surface pattern that substantially matches or corresponds to the surface pattern of the shell 102. The display body 122 may form a second peripheral shape 150. In some embodiments the attachment element 120 also forms part of the second peripheral shape 150. In some embodiments, the second peripheral shape 150 may be a rectangle, square, circle, other polygon, rounded versions of the same or an irregular shape. The first peripheral shape 146 and the second peripheral shape 150 may be complementary shapes such that the display body 122 and/or attachment element 120 may be removably received within the recess 140.

In some embodiments, the shell 102 may include a surface pattern 124 and the display body 122 may include a surface pattern 126. Either or both of the surface pattern 124 and the surface pattern 126 may include one or more three-dimensional relief features that protrude above, or be recessed below, the outside surface of the shell 102. In other embodiments, the surfaces of the shell and/or the display body 122 may be smooth. One embodiment of a display body 122*a* is shown for example in FIG. 2A. The display body 122*a* may have a surface pattern 126. In some embodiments, the display body 122 may have no surface pattern. In some embodiments, the surface pattern 124 of the display body 122 and the surface pattern 126 of the luggage shell 102 may be different patterns such that the display body 122 is easily noticeable on the outer surface of the luggage article 100. In some embodiments, the display body 122*b* has a surface pattern 124 that matches, corresponds to, and/or aligns with the surface pattern 124 of the shell 102. Thus, the display body 122*b* may be concealed or blend with the exterior of the shell 102 such that the display body 122*b* is not easily noticeable on the shell 102.

Figure 4:
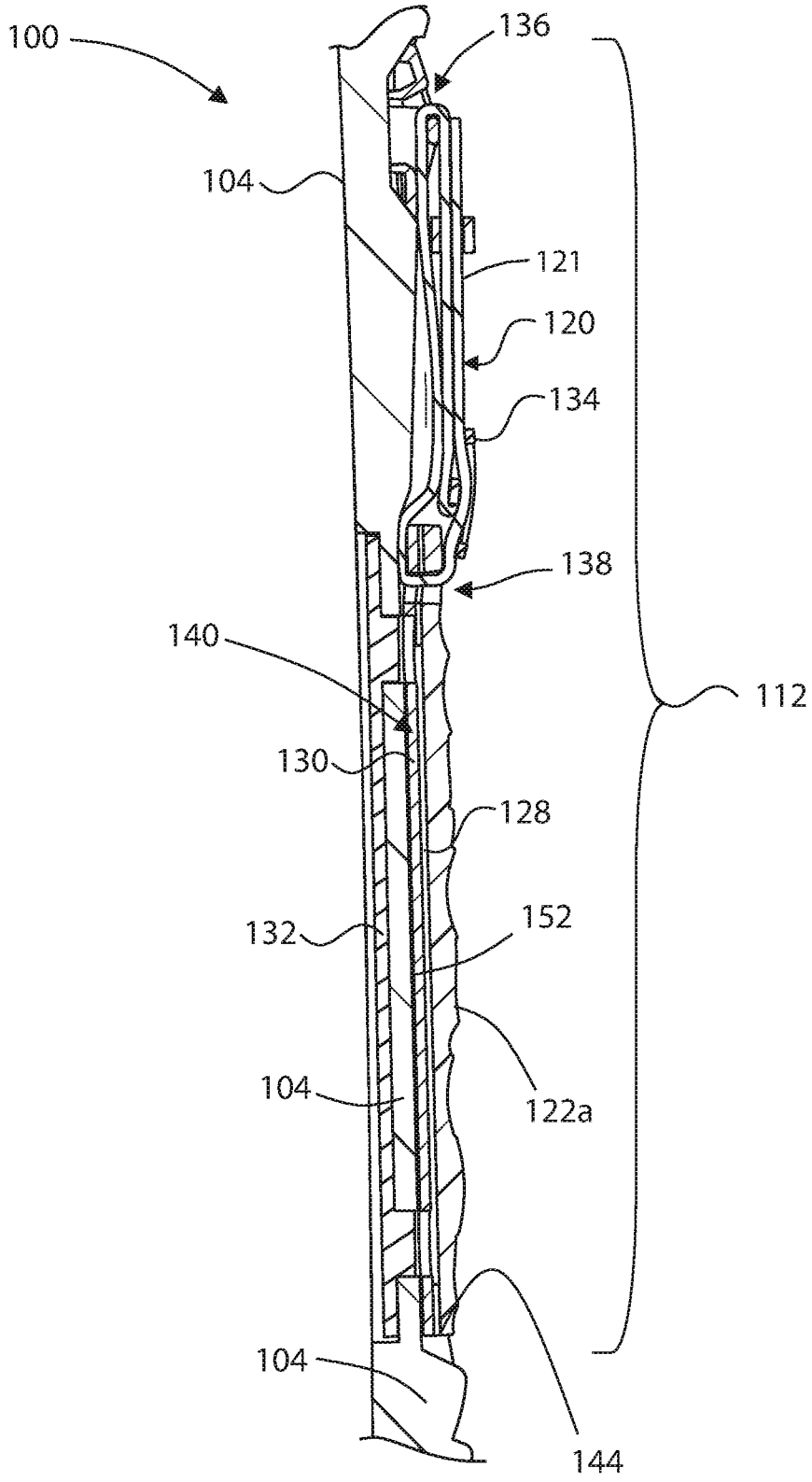
FIG. 4 is a partial section view of the identification tag and luggage article of FIG. 1 taken along line 4-4 of FIG. 3.

As shown for example in FIG. 4, the display body 122 may include, be integrally formed with, or coupled to a first attachment element 130, which in one example has a magnetic property (for example, a magnet, or a metal attracted to a magnet). For example, the first attachment element 130 may be molded into the display body 122, may be secured to the display body 122 with one or more fasteners, may be secured with an adhesive, or may be secured with stitching to the display body 122. In the example shown in FIG. 4, the first attachment element 130 is coupled to the bottom side of the display body 122*a*. The information element 128 is disposed between the display body 122*a* and the first attachment element 130. The first attachment element 130 may include a window or other aperture formed therein such that the information element 128 is visible beneath the first attachment element 130. For example, the first attachment element 130 may form, or be included in, the entirety of or a portion of a peripheral frame around the edge of the information element such that the information 164 is visible through the transparent element 190 in the layered structure of the identification tag assembly 112.

The identification tag assembly 112 may include an attachment element 120, which may be for example a strap 121 (e.g. FIG. 2A) or a rigid member 123 (e.g. FIG. 7B), couplable to the display body 122. The attachment element 120 may be flexible, such as being a strap, tether, ribbon, chain, or may be rigid, such as a link member, or the like adapted to movably secure the display body 122 to the luggage article 100 via a fixed attachment element 118 such as an anchor 118. In some embodiments, the attachment element 120 and the anchor 118 are optional. For example an aperture 138 may be formed in the display body 122 and adapted to receive the attachment element 120. Similarly, an anchor 118 may be affixed to, or integrally formed with, the shell 102 and adapted to couple with, such as by receiving, the attachment element 120. In some embodiments, the anchor 118 may include an anchor aperture 136 formed therein and adapted to receive the attachment element 120, and the anchor 118 may be securely, permanently, or removably recessed into, below, or flush with, the shell 102. The attachment element 120, such as the example of the strap 121, may be fitted with or coupled to a locking mechanism 134, such as a buckle or clasp that can adjust the length of the attachment element 120. For example, the length of the attachment element 120 may be adjusted to locate the display body 122 within the recess 140. The attachment element 120 may be fitted with or coupled to a retainer 162 to secure a loose end of the attachment element 120. The attachment element 120 may be inserted through the aperture 138 and the anchor aperture 136 to flexibly secure the display body 122 to the luggage article 100.

As noted above, and shown in FIG. 7A, the attachment element 120 may be a strap or tether 121 and the attachment element 118 may be an anchor, where the strap 121 is coupled to both the display body 122 and the anchor 118. The strap 121 may be made of a flexible material, such as rubber, plastic, leather, or man-made or natural woven or unwoven materials, to flexibly secure the display body 122 to the shell 102. The display body 122 may have an aperture 138 formed therein and adapted to receive or otherwise engage attachment element 120. The strap 121 having flexible properties allows the display body 122 to be moved up and away from the luggage case in a variety of directions in order to read the information element 128, including being moved normally away from the luggage case, rotated relative to the luggage case, twisted about the length of the strap 121, or a combination of motions.

In another example as noted above and shown in FIG. 7B, the attachment element 120 may be a rigid element 123 attached between the attachment element 118 (e.g. an anchor), or the shell of the luggage case, and the display body 122, for example with the display body 122 being received in recess 140. The rigid element 123 may be a single link 125 pivotally attached at one end 127 to the attachment element 118 and pivotally attached at the other end 129 to the display body 122. The rigid element 123 may be received in the channel 155 similarly as noted above for the other example of the attachment element 121, and be generally flush with the outer surface of the luggage case. Alternatively, the rigid element 126 may be positioned adjacent the surface of the luggage case and not received in a channel 155. In this example, the link 123 may be made of a rigid material, such as metal, inflexible plastic, or other stiff materials. The pivot connections at either end of the link 123 movably secures the display body 122 to the shell 102. The link 123 may be more than one rigid body pivotally attached together. With the link structure, the display body 122 may be moved away from the luggage case to be viewed, and generally in a direction normal to the pivot connections at either end of link or links.

Figure 6:
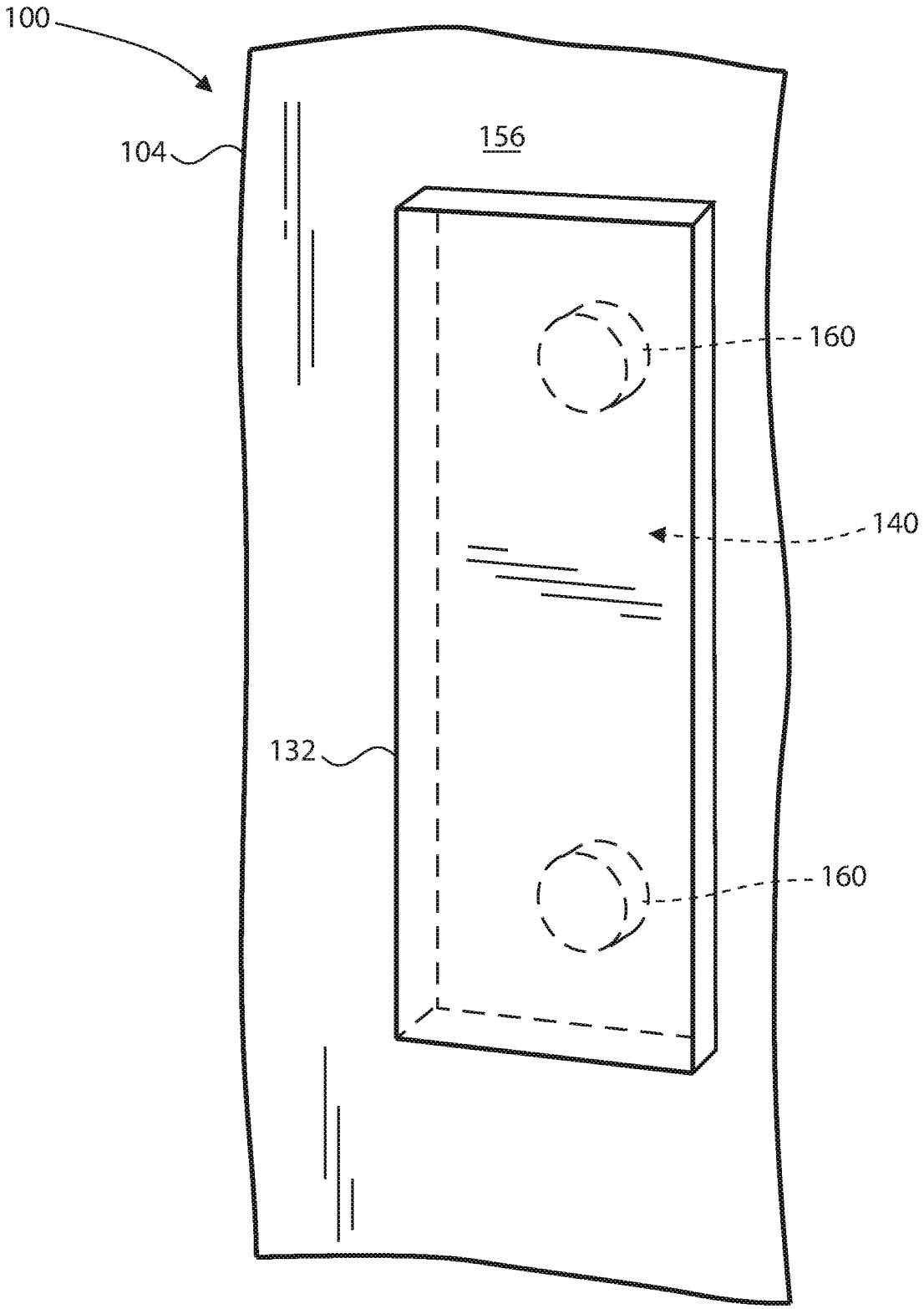
FIG. 6 is a partial rear view of a portion of the identification tag of the luggage article of FIG. 1.

As shown for example in FIG. 6, a second attachment element 132, such as a magnet or a substantially flat and thin plate with a magnetic property, may be coupled to, or integrally formed with, the shell 102, and for example as shown the second attachment element 132 may be coupled to the inside surface 156 of the shell. In some embodiments, multiple second attachment elements 132 may be used, such as discrete discs disposed on either the inside or outside surfaces of the shell 102. For example, the multiple second attachment elements 132 may be discrete round magnetic discs disposed on one or more of the first or second base walls 152/154 and/or first or second peripheral walls 144/148, on either the inside or outside surface of the shell 102. In some embodiments, the second attachment element 132 may be adjacent the recess 140, such as attached to the inside surface of the first base wall 152, integral with the first base wall 152, or all or part of the first base wall 152. In some embodiments, may be attached to the inside surface of the first/second peripheral walls 144/148, or integral with the first/second peripheral walls 144/148, or all or part of the first/second peripheral walls 144/148. In some embodiments, the second attachment element 132 may be disposed on the outside surface of the shell 102 in the recess 140, such as disposed on or adjacent to one or more of the first base wall 152, first peripheral walls 144, and/or the second peripheral wall. In some examples, the second attachment element may be a plurality of metal particles adhered to, or molded with, the shell 102 in or adjacent to the recess, such as when the first attachment element includes a magnet disposed in the display body. In some embodiments, the second attachment element 132 may be molded into the shell 102, may be secured to the shell 102 with one or more fasteners 160, or adhered to the shell 102 with an adhesive. Some examples of fasteners 160 include, but are not limited to, screws, bolts, rivets, clamps, pins, or the like.

The first attachment element 130 and the second attachment element 132 are adapted to together releasably secure the display body 122 in the recess 140. In many embodiments the first attachment element 130 and the second attachment element 132 are magnetic elements that generate an attractive magnetic force therebetween. Magnetic elements may be discrete and positioned in a line or across an area; or may be continuous and extend along all or a portion of the first base wall 152, the first peripheral wall 144, and/or second peripheral wall 148. Magnetic elements may be peripherally located or centrally located in either the identification tag assembly 112 or the recess 140. In some embodiments, an attachment element may be located in the recess 140 on the outside of the shell 102, such as for example a thin plate positioned on the first base wall 152 of the recess 140, the second base wall of the channel 155, or peripherally either or both of the recess 140 and channel 155 along the first peripheral wall 144, and/or second peripheral wall 148.

Either or both of the first attachment element 130 and the second attachment element 132 may be any suitable materials that generate an attractive magnetic force therebetween. For example, one of the first attachment element 130 and/or the second attachment element 132 may be formed of a metal and the other of the first attachment element 130 and/or second attachment element 132 may be a magnet, such as a permanent magnet, that causes an attractive magnetic force between the first attachment element 130 and the second attachment element 132. In other embodiments, the first attachment element 130 and the second attachment element 132 may be oppositely-polarized magnets that attract one another. Either or both of the first attachment element 130 and/or second attachment element 132 may be formed of iron, cobalt, nickel, aluminum, samarium, neodymium or combinations thereof, or the like. When the display body 122 is brought in proximity to the recess 140, the magnetically attractive force between the first attachment element 130 and the second attachment element 132 may cause the display body 122 to "snap" into the recess 140, thus securing the display body 122 to the luggage article 100 and providing haptic feedback to the user such as to indicate that the identification tag assembly 112 is secure in the recess 140. However, the magnetic force between the first attachment element 130 and the second attachment element 132 may be light enough that a user can pry the display body 122 from the recess 140 such as to view or change the ID information 164. Thus, the identification tag assembly 112 may be securely, but removably coupled to the shell 102. Also, the identification tag assembly can closely match the external pattern of the shell 102 of the luggage article 100 if desired (such as with the display body 122*b*), or can be easily detectable if desired (such as with the display body 122*a*).

In some embodiments, the first attachment element 130 and the second attachment element 132 may be releasable mechanical fasteners such as snaps, buttons, hook-and-loop fasteners, or any other suitable device that can releasably secure the display body 122 with in the recess 140.

Advantages of the identification tag assembly 112 may include keeping the identification tag assembly 112 flush, nearly flush, or even recessed with respect to the outer surface of the shell 102 such that the identification tag assembly 112 is not easily damaged, scratched, or lost while the luggage article 100 is being handled. Additionally, the information element 128 may be concealed (e.g., placed face down) such that the ID information is not displayed to persons near the luggage article 100 thus maintaining the user's privacy.

Figure 8:
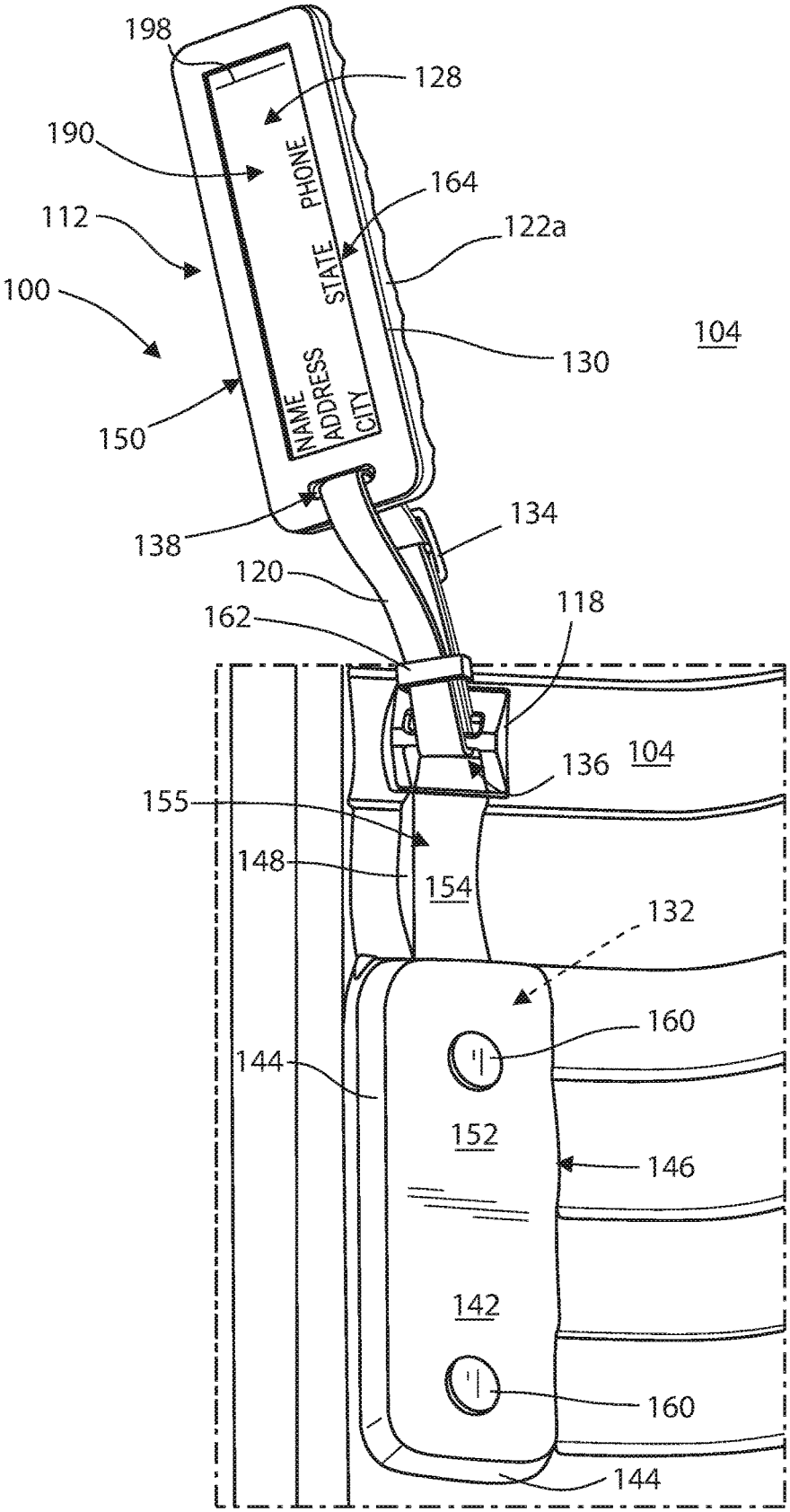
FIG. 8 is a view of the identification tag and luggage article of FIG. 1 in a second configuration.

The display body 122 may include or be adapted to receive an information element 128 suitable to display ID information or other information. For example, as shown in FIG. 8, the ID information may include a name, address, city, state, country, phone number, email address or other information that associates the luggage article 100 with a person or organization. Such information may be useful to reunite a lost luggage article 100 with its owner, and/or differentiate between similar luggage articles 100. The information element 128 may be, by way of non-limiting example, a business card, a piece of paper or a sticker with information written or printed on it, or an electronic tracking device, such as an AirTag™ or other electronic remote tracking device. The identification tag assembly 112 may have an opaque side and a transparent side. The information element 128 may be visible, and/or selectively receivable between the opaque side and the transparent side. For example, the identification tag assembly 112 may include a clear, transparent, or semi-transparent or transparent element 190 beneath which the information element 128 is adapted to be received. For example, the transparent element 190 may have a receptacle 198 such as a slot formed therein and adapted to receive an information element 128. For example, the information element 128 may be receivable beneath the transparent element 190 such that the information element 128 is visible but protected from damage. The information element 128 may be removably received in the receptacle. The above structure may be suitable for a business card, piece of paper or sticker examples noted above. The information element 128 in another example may include a structure configured to receive or otherwise engage with an electronic remote tracking device, such as an AirTag™ or other electronic remote tracking device.

Figure 7A:
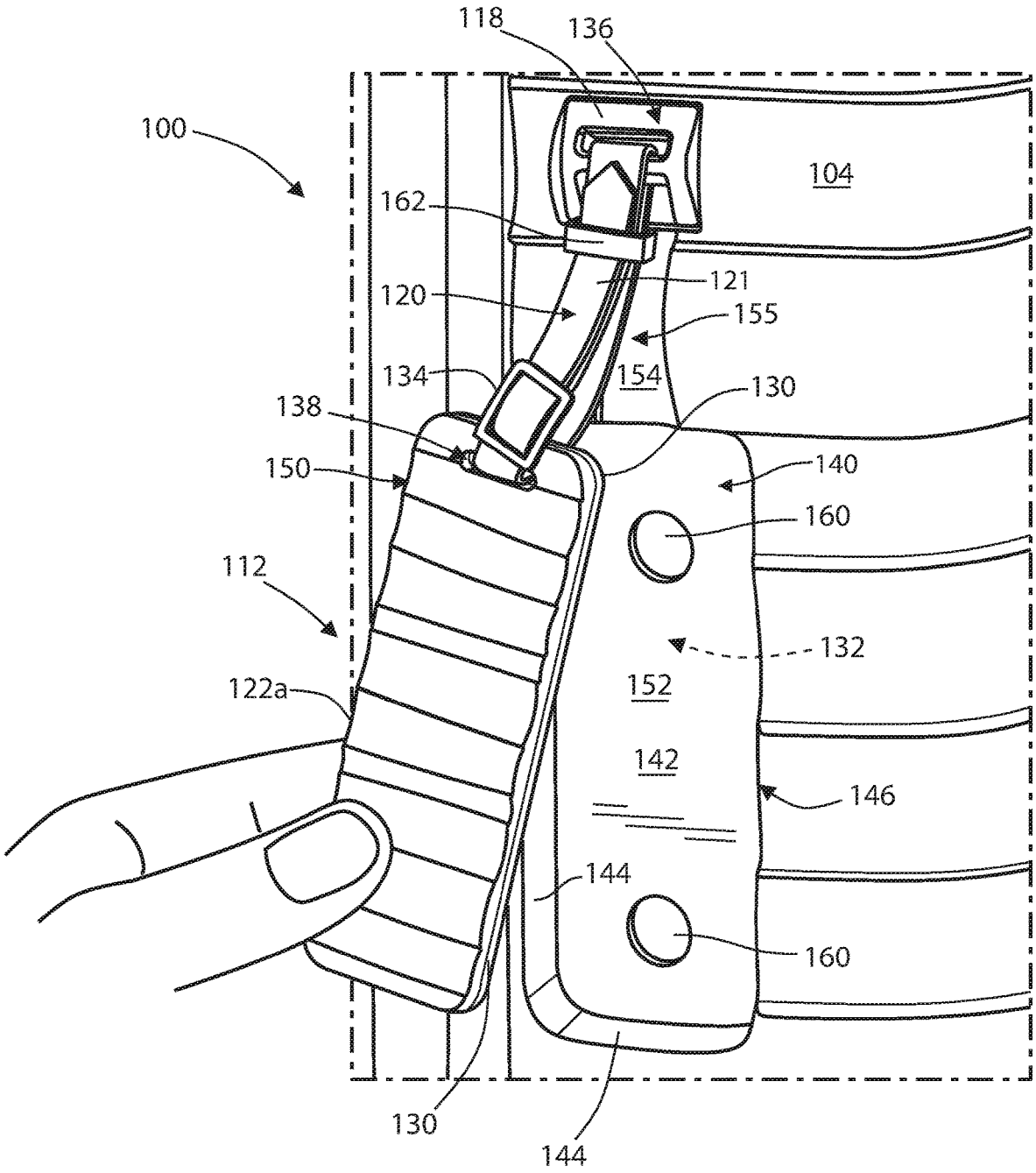
FIG. 7A is a view of the identification tag and luggage article of FIG. 1 with a first example of an attachment element and in a first configuration.
Figure 7B:
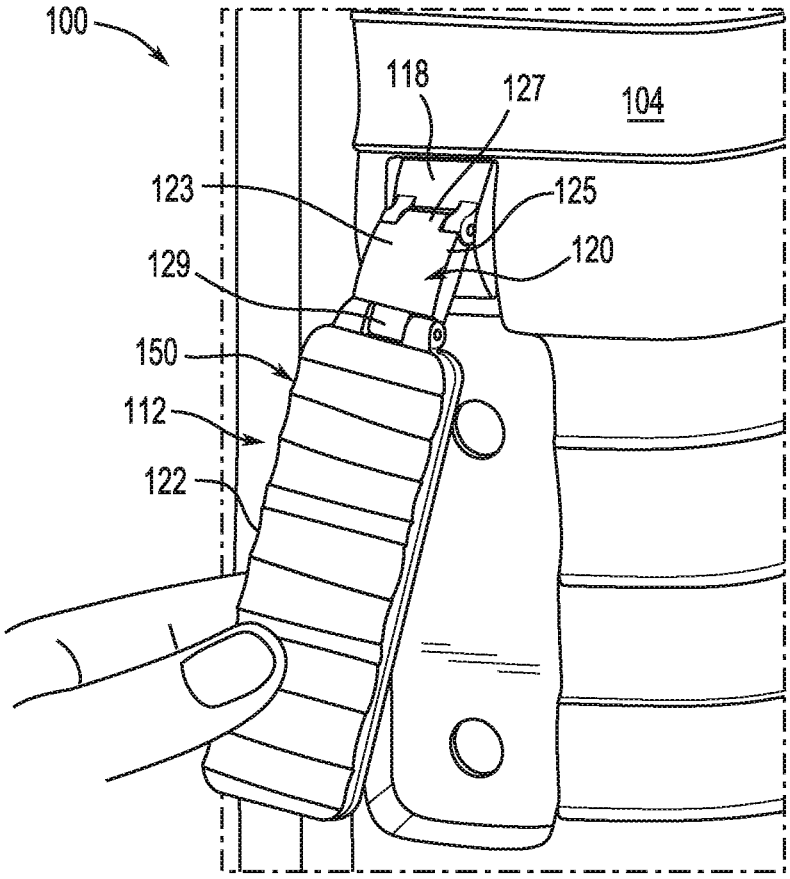
FIG. 7B is a view of the identification tag of the luggage article of FIG. 1 with a second example of an attachment element.

As shown for example in FIGS. 7A, 7B and FIG. 8, the display body 122 may be easily removed from the recess 140 by a user's fingers. The display body 122 may be manipulated such that a user can view the information 164 on the information element 128. While being thusly manipulated, the display body 122 is tethered to the shell 102 by the flexible element and the anchor such that the display body 122 does not come loose. The display body 122 can be easily re-stowed in the recess 140 as simply as by the user dropping the display body 122. The attractive magnetic force between the first attachment element 130 and the second attachment element 132 may cause the display body 122 to "snap" into the recess 140.

The description of certain embodiments included herein is merely exemplary in nature and is in no way intended to limit the scope of the disclosure or its applications or uses. In the included detailed description of embodiments of the present systems and methods, reference is made to the accompanying drawings which form a part hereof, and which are shown by way of illustration specific to embodiments in which the described systems and methods may be practiced. These embodiments are described in sufficient detail to enable those skilled in the art to practice presently disclosed systems and methods, and it is to be understood that other embodiments may be utilized, and that structural and logical changes may be made without departing from the spirit and scope of the disclosure. Moreover, for the purpose of clarity, detailed descriptions of certain features will not be discussed when they would be apparent to those with skill in the art so as not to obscure the description of embodiments of the disclosure. The included detailed description is therefore not to be taken in a limiting sense, and the scope of the disclosure is defined only by the appended claims.

From the foregoing it will be appreciated that, although specific embodiments of the invention have been described herein for purposes of illustration, various modifications may be made without deviating from the spirit and scope of the invention.

The particulars shown herein are by way of example and for purposes of illustrative discussion of the preferred embodiments of the present invention only and are presented in the cause of providing what is believed to be the most useful and readily understood description of the principles and conceptual aspects of various embodiments of the invention. In this regard, no attempt is made to show structural details of the invention in more detail than is necessary for the fundamental understanding of the invention, the description taken with the drawings and/or examples making apparent to those skilled in the art how the several forms of the invention may be embodied in practice.

As used herein and unless otherwise indicated, the terms "a" and "an" are taken to mean "one", "at least one" or "one or more". Unless otherwise required by context, singular terms used herein shall include pluralities and plural terms shall include the singular.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "above," and "below" and words of similar import, when used in this application, shall refer to this application as a whole and not to any particular portions of the application.

Of course, it is to be appreciated that any one of the examples, embodiments or processes described herein may be combined with one or more other examples, embodiments and/or processes or be separated and/or performed amongst separate devices or device portions in accordance with the present systems, devices and methods.

Finally, the above discussion is intended to be merely illustrative of the present system and should not be construed as limiting the appended claims to any particular embodiment or group of embodiments. Thus, while the present system has been described in particular detail with reference to exemplary embodiments, it should also be appreciated that numerous modifications and alternative embodiments may be devised by those having ordinary skill in the art without departing from the broader and intended spirit and scope of the present system as set forth in the claims that follow. Accordingly, the specification and drawings are to be regarded in an illustrative manner and are not intended to limit the scope of the appended claims.

What is claimed is:

1. A luggage article comprising:

a shell forming an internal storage volume, wherein:

a recess is formed in the shell and includes:

a base wall that defines a substantially planar surface, and a first peripheral wall that at least partially surrounds the base wall and forms a peripheral shape of the recess;

an identification tag assembly including:

a substantially planar display body defining a second peripheral shape, and configured to receive an information element, and a first attachment element;

a second attachment element coupled to the shell proximate to the recess, wherein:

the second peripheral shape of the display body compliments the peripheral shape of the recess such that the display body is receivable in the recess, and the first attachment element and the second attachment element together releasably secure the display body to the shell in the recess, a third attachment element coupled to the display body, wherein the third attachment element is a flexible tether, or the third attachment element is a link structure of one or more rigid bodies pivotally attached together or to the shell.

2. The luggage article of claim 1, wherein the first attachment element and the second attachment element comprise respective first and second magnetic elements that generate an attractive magnetic force therebetween.

3. The luggage article of claim 2, wherein one of the first magnetic element or the second magnetic element comprises a permanent magnet.

4. The luggage article of claim 3, wherein the permanent magnet comprises at least one of iron, cobalt, nickel, aluminum, samarium, neodymium, or combinations thereof.

5. The luggage article of claim 1, wherein the shell includes a first surface pattern and the display body includes a second surface pattern.

6. The luggage article of claim 5, wherein the first surface pattern and the second surface pattern are different than one another.

7. The luggage article of claim 5, wherein the first surface pattern and the second surface pattern correspond.

8. The luggage article of claim 1, wherein the first attachment element and the second attachment element comprise respective first and second releasable mechanical fasteners.

9. The luggage article of claim 1, further comprising:

a channel defined in the shell and in communication with the recess;

the third attachment element further defining a portion of the second peripheral shape, wherein the third attachment element is receivable in the channel.

10. The luggage article of claim 9, further comprising a fourth attachment element coupled to the shell and the third attachment element and configured to movably secure the display body to the shell.

11. The luggage article of claim 10, wherein the peripheral shape and the second peripheral shape are such that the display body and the third attachment element are both receivable in the recess.

12. The luggage article of claim 1, wherein the identification tag assembly includes an opaque side and a transparent side, wherein the information element is selectively receivable between the opaque side and the transparent side and is visible through the transparent side.

13. The luggage article of claim 12, wherein the transparent element includes a receptacle formed therein, the transparent element forming a pocket with the display body adapted to receive the information element.

14. An identification tag assembly for a luggage article including:

a recess formed in a shell of the luggage article, the recess including:

a base wall that defines a substantially planar surface, and a first peripheral wall that at least partially surrounds the base wall and forms a peripheral shape of the recess;

a display body defining a second peripheral shape and configured to receive an information element configured to display information;

a first magnetic element;

a second magnetic element coupled to a surface of the luggage article proximate to the recess; wherein:

the peripheral shape and the second peripheral shape are such that the display body is receivable in the recess, and the first magnetic element and the second magnetic element together releasably retain the display body within in the recess, and an attachment element coupled to the display body, wherein the attachment element is a flexible tether, or the attachment element is a link structure of one or more rigid bodies pivotally attached together or to the shell.

15. The identification tag assembly of claim 14, wherein one of the first magnetic element or the second magnetic element comprises a permanent magnet.

16. The identification tag assembly of claim 15, wherein the permanent magnet comprises at least one of iron, cobalt, nickel, aluminum, samarium, neodymium, or combinations thereof.

17. The identification tag assembly of claim 14, further comprising:

the attachment element further defining a portion having the second peripheral shape, and a fixed attachment element coupled to the shell and the attachment element and configured to movably secure the display body to the shell, wherein:

a channel is defined in the shell and in communication with the recess, and the attachment element is receivable in the channel.

18. A method of releasably securing an identification tag assembly to a luggage article comprising:

providing a shell of the luggage article forming an internal storage volume, wherein:

a recess is formed in the shell and includes:

a base wall that defines a substantially planar surface, and a first peripheral wall that at least partially surrounds the base wall and forms a peripheral shape in the shell;

providing the identification tag assembly including:

a display body defining a second peripheral shape and configured to receive an information element configured to display information, and a first attachment element;

providing a second attachment element coupled to the shell proximate to the recess, wherein:

the peripheral shape and the second peripheral shape are such that the display body is receivable in the recess, and the first attachment element and the second attachment element together releasably secure the display body to the shell in the recess; and providing a third attachment element coupled to the display body, wherein the third attachment element is a flexible tether, or the attachment element is a link structure of one or more rigid bodies pivotally attached together or to the shell.

19. The method of claim 18, wherein the first attachment element and the second attachment element comprise respective first and second magnetic elements that generate an attractive magnetic force therebetween.

* * * * *